US005265564A

United States Patent [19]

Dullaway

[11] Patent Number: 5,265,564

[45] Date of Patent: Nov. 30, 1993

[54] RECIPROCATING PISTON ENGINE WITH PUMPING AND POWER CYLINDERS

[76] Inventor: Glen A. Dullaway, 49 Scarborough Road, Redcliffe, Queensland 4020, Australia

[21] Appl. No.: 778,222

[22] PCT Filed: Jun. 19, 1990

[86] PCT No.: PCT/AU90/00261

§ 371 Date: Dec. 13, 1991

§ 102(e) Date: Dec. 13, 1991

[87] PCT Pub. No.: WO90/15917

PCT Pub. Date: Dec. 27, 1990

[51] Int. Cl.[5] ..... F02B 33/22

[52] U.S. Cl. ..... 123/70 R; 123/560; 417/364

[58] Field of Search ..... 123/70 R, 560, 70 V; 417/364

[56] References Cited

U.S. PATENT DOCUMENTS

| | | | |
|---|---|---|---|
| 1,831,664 | 11/1931 | Hoch . | |
| 1,881,582 | 10/1932 | Holloway . | |
| 2,281,821 | 5/1942 | Balmer . | |
| 2,347,444 | 4/1944 | Vincent . | |
| 3,081,071 | 3/1963 | Barnes et al. . | |
| 3,388,693 | 6/1968 | James . | |
| 3,623,463 | 11/1971 | DeVries | 123/70 R |
| 3,675,630 | 7/1972 | Stratton | 123/70 R |
| 3,880,126 | 4/1975 | Thurston et al. | 123/70 R |
| 4,357,916 | 11/1982 | Noguchi et al. | 123/51 BA |
| 4,455,976 | 6/1984 | McCandless | 123/197 R |
| 4,458,635 | 7/1984 | Beasley | 123/68 |
| 4,491,096 | 1/1985 | Noguchi et al. | 123/51 B |
| 4,565,167 | 1/1986 | Bryant | 123/70 R |
| 4,834,032 | 5/1989 | Brennan | 123/51 BA |
| 4,920,937 | 5/1990 | Sasaki et al. | 123/305 |
| 5,072,589 | 12/1991 | Schmitz | 123/70 R |

FOREIGN PATENT DOCUMENTS

| | | |
|---|---|---|
| 105890 | 11/1938 | Australia . |
| 143571 | 9/1951 | Australia . |
| 213330 | 2/1958 | Australia . |
| 0075643 | 4/1983 | European Pat. Off. . |
| 3007746 | 9/1981 | Fed. Rep. of Germany . |
| 820925 | 11/1937 | France . |
| 2444161 | 7/1980 | France . |
| 2477224 | 9/1981 | France . |
| 60-153427 | 8/1985 | Japan . |
| 62-111123 | 5/1987 | Japan . |
| 62-135615 | 6/1987 | Japan . |
| 169799 | 10/1921 | United Kingdom . |
| 183229 | 7/1922 | United Kingdom . |
| 265227 | 8/1927 | United Kingdom . |
| 2071210 | 9/1981 | United Kingdom . |

*Primary Examiner*—David A. Okonsky

*Attorney, Agent, or Firm*—Hoffman Wasson & Gitler

[57] ABSTRACT

An internal combustion engine power unit comprises two power cylinders (3, 4) spaced equidistant about a pumping cylinder (5). All cylinders operate on two-stroke cycles, the power cylinders (3, 4) having a phase difference of 180°. Power piston assemblies (13, 14) in the power cylinders (3, 4) drive crankshaft (1). Pumping piston (16) and separate crankshaft (2) are driven at twice the cyclic speed of the power pistons (13, 14) and crankshaft (1) through gear train (6, 7) between the respective crankshafts (1, 2). Air inducted into pumping cylinder (5) via intake ports (20) is compressed and passed alternately to power cylinders (3, 4) via valve controlled transfer passages (21, 24). All valves, ports and gas passages are found in a cylinder head (19). Timed fuel injection and ignition are provided. An engine may comprise one or more power units. There is also disclosed a turbo-charged diesel engine comprising two power units in "V" configuration.

23 Claims, 3 Drawing Sheets

RECIPROCATING PISTON ENGINE WITH PUMPING AND POWER CYLINDERS

TECHNICAL FIELD

This invention relates to reciprocating piston internal combustion engines of the type wherein, pumping and power cylinders are operated on two stroke cycles.

BACKGROUND ART

Engines of this type have been disclosed in numerous prior art which have intended to improve the efficiency and or power to weight ratio thereof. U.S. Pat. No. 1,881,582 shows a design which has a pumping cylinder driven at twice the cyclic speed of and alternately supplying a intake scavenging charge to two power cylinders, via transfer ports which communicate with the lower cylinder walls of the power cylinders, hence being timed by the power pistons. Although this design marginally increases the scavenging efficiency attainable and as compared to crankcase compression type two stroke engines, this design has and retains numerous efficiency problems of, including the fundamental inefficiency of, the conventional two stroke engine. The said inefficiency results from the opening of the transfer ports in the lower cylinder walls and which reduces the volume through which expansion occurs with the said reduction being used instead for a half of the transfer scavenging phase. Furthermore this design, due to the said transfer to the lower cylinder walls, has no potential for significant efficiency gains to be attained if valve controlled constant volume combustion chambers are to be used.

A second type of engine which has pumping and power cylinders operating on two stroke cycles and which have intended to overcome the above said undesirable features are typically disclosed in U.S. Pat. Nos. 3,880,126 and 4,458,635. These designs have the pumping cylinder transferring the intake charge through valve timed ports which open into the power cylinder head section. U.S. Pat. No. 3,880,126, utilizes a combustion chamber which is in constant communication with the power cylinder and which has an excessive number of components whilst overall efficiency and power output are severley limited by a poor scavenging efficiency which primarily results from the long transfer scavenging phase required of the design. This further exacerbats the obvious power to weight ratio limitations of the design. U.S. Pat. No. 4,458,635, utilizes a valve controlled constant volume combustion chamber which foregoing the supercharging system used that results in a similar said fundamental inefficiency, increases the scavenging and combustion efficiency and hence overall efficiency is also maginally increased. Subsequently, only an average power to weight ratio results whilst an excessive number of components is still a major problem.

A further design of engine which shares similiar cylinder, port and valve locations of the presented invention but which is outside of the technical field of this invention in that the power cylinders operate on four stroke cycles, is typically shown in GB, A PATENT NO. 2071210. As such the pumping cylinder is used only as a supercharging device and is not necessary for the operation of the engine as is required in the presented invention.

DISCLOSURE OF INVENTION

The presented invention discloses a novel design of engine which, significantly increases the thermal efficiency and power to weight ratio of all above said types of engines and increases the scavenging efficiency of the above said engine types which are within the field of this invention, and decreases the number of components required for, the above said second type of engine.

The principal object of this invention then describes a engine which has one or more units with a unit having, a pumping cylinder with a pumping piston reciprocable therein and two power cylinders having power pistons reciprocable therein. All said cylinders operate on two stroke cycles with the pumping piston being driven by means to reciprocate twice as often as the power pistons. The power pistons relative to each other, are phased or are phased about, one stroke apart. A cylinder head closes adjacent ends of all said cylinders, and may extend down to form the upper part of the cylinder walls. Transfer ports communicate the head section of the pumping cylinder with that of the power cylinders, and control thereof is by transfer valves which control communication between each respective transfer port and power cylinder. A combustion chamber wherein atleast a major part of combustion occurs is provided for each power cylinder. Said chamber remains in constant communication therewith, or the said chamber may be of the constant volume type and provide constant volume combustion, and be positioned in the head, between the respective transfer and secondary valves with said secondary valves controlling communication to the power cylinders, whilst in either case, from hereinafter and above, the opening of a respective transfer valve of a power cylinder is referred to as opening into that said power cylinder, unless is specifically stated. The pumping cylinder induces thereinto, and through a intake valve controlled intake port which passes through the said head thereof, atleast a major portion of the intake charge which is atleast 60% of the air used in combustion. The intake charge of consecutive pumping cylinder cycles, is then transferred alternately to the said power cylinders through the respective transfer ports. Valve controlled exhaust ports exit the power cylinders through the said head and provide for the exhausting of expanded gases.

Preferable, the pumping piston of a said unit, is equally distanced to the power cylinders thereof and leads the piston of the power cylinder which the intake charge is to be or is being transferred into, to the 'top dead centre' (from hereinafter referred to as 'TDC') position, by less than 80% of the time required for a power piston decreasing volume stroke. A separate mainshaft mechanism to that which causes reciprocation of the power pistons, causes reciprocation of the pumping piston, and the pump mainshaft is driven by means, from the power mainshaft or the output shaft of the engine.

It is further preferred that the abovesaid engine is operated in a manner wherein, the said transfer and exhaust valves of the power cylinders, open and close in the same, or a similar timed relation to the movement of the piston of the respective power cylinders. The said induction of said intake charge, occurs substantially on the increasing volume stroke of the pumping piston, and the said induced intake charge is then transferred to a said power cylinder, substantially on the decreasing volume stroke of the pumping piston. After combustion occurs when the piston of a respective power cylinder is about its TDC position, the said power pistons are forced to move through to BDC with exhaust occurring when the respective exhaust valves open, which is after the respective power piston has moved through atleast 45% of its down stroke. A said exhaust valve then remains open for atleast 35% of the time required for a power piston stroke, and atleast substantially, until the respective transfer valve opens to allow for atleast partial scavenging of the remaining volume of the said power cylinder. Substantially atleast over the said engine operating load and speed range, as a said intake charge is transferred to a power cylinder, the pumping cylinder performs atleast a part of the work required to raise the pressure of the intake charge, to a pressure which is suitable for combustion. The said valves which enclose a said combustion chamber volume and including atleast the said transfer valves, close before 30% of the combustible mass is combusted, and substantially atleast close before combustion occurs. Preferred valve timings which allow for the efficient operation of the said engine in the abovesaid method are also stated.

A further object of this invention has the engine just described being optionally modified by various improvements thereto and which have; the said transfer ports being the only ports where air is administered to the power cylinders, and being located higher than the reversal point of the piston top; the pumping cylinder mainshaft being located directly above the power cylinder mainshaft; the valve train actuating means and or other auxiliary device, being driven from means provided on or being located on the pumping cylinder mainshaft or, on the power cylinder mainshaft between the said power cylinders and which provides for a compact engine and unit to be achieved; desirable combustion chamber designs of both abovesaid combustion chamber types with the transfer and secondary valves being poppet type valves and with desirable locations and timings thereof. A still further object of this invention has enviable V configurations and turbocharged designs of the novel engine whilst a further object has the pumping cylinder utilizing crankcase compression thereof to improve the charging efficiency thereof. A variable valve timing mechanism which varies atleast the closing time of the exhaust valve so that its closing time may be varied to allow efficient operation under transient operating conditions is yet another object.

MODES FOR CARRYING OUT THE INVENTION

Figure 1:
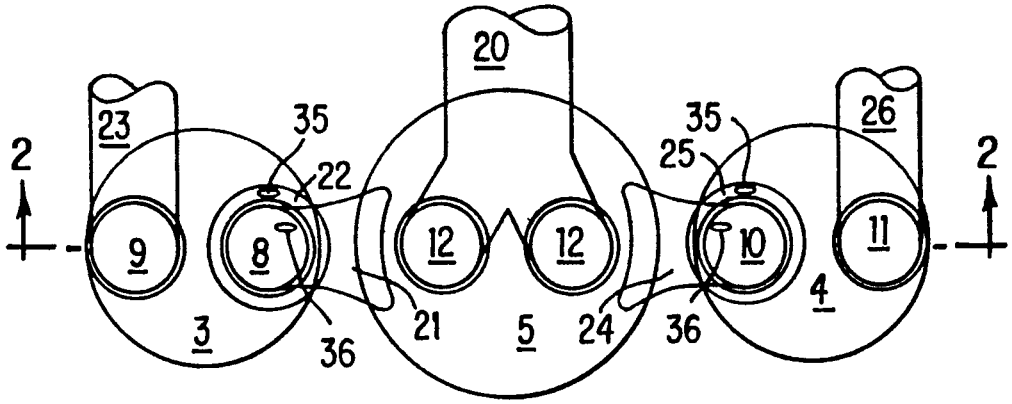
FIG. 1 is a top schematic view of the preferred design which is a inline single unit and showing the cylinders, ports, combustion chamber and valve opening locations thereof.

Referring to all modes for carrying out the present invention, each said unit has a pumping cylinder 5 with a pumping piston 16 reciprocable therein and first and second power cylinders, respectively 3 and 4 with first and second power pistons respectively 13 and 14 reciprocable within their respective power cylinders. All cylinders of a unit share a parallel axis and a common block 18 and a common head 19, whilst the pumping cylinder is evenly distanced to each of the power cylinders. A pumping crankshaft 2 and pumping conrod 17 cause reciprocation of the pumping piston 16 and a power crankshaft 1 and power conrods 15 cause reciprocation of the said power pistons. Each said crankshaft is supported for rotation by bearing means whilst journal means which are not shown in the drawings, provide pivotal movement at the conrod crankshaft pivots and the conrod piston pivot. A pump drive gear 7 which is fixed to each of the pumping crankshafts 2, cooperates with, is driven by, and is one half the diameter of, the power crankshaft gear 6 which is fixed to the power crankshaft 1. This gear arrangement then provides for the pumping pistons 16 to be reciprocated at and cyclicly operated at, twice that of the power pistons. The phasing of the power pistons of a unit relative to each other, is one hundred and eighty power 'crankshaft crankangle' (from hereinafter is referred to as 'CA') degrees. The first and second transfer ports respectively 21 and 24, remain in constant communication with the pumping cylinder. The crankshafts for carrying out all modes of the invention, are of the one piece type whilst all conrods are of the two piece type and bolt on to the respective crankshafts from the undersides thereof, for pivotal movement therearound. Of course the components and auxiliaries not illustrated and referred to, and which are required for the efficient operation of the engine, are included in all modes for carrying out the invention whilst water cooling passages are shown in the sectioned walls of FIGS. 2 and 4 but are not numbered to reduce cluttering thereof. Furthermore, the respective components of the first and second power cylinders are respectively referred to as the first and second said components, or they are referred to as the respective components of the power cylinder of which the description is directed to.

Figure 2:
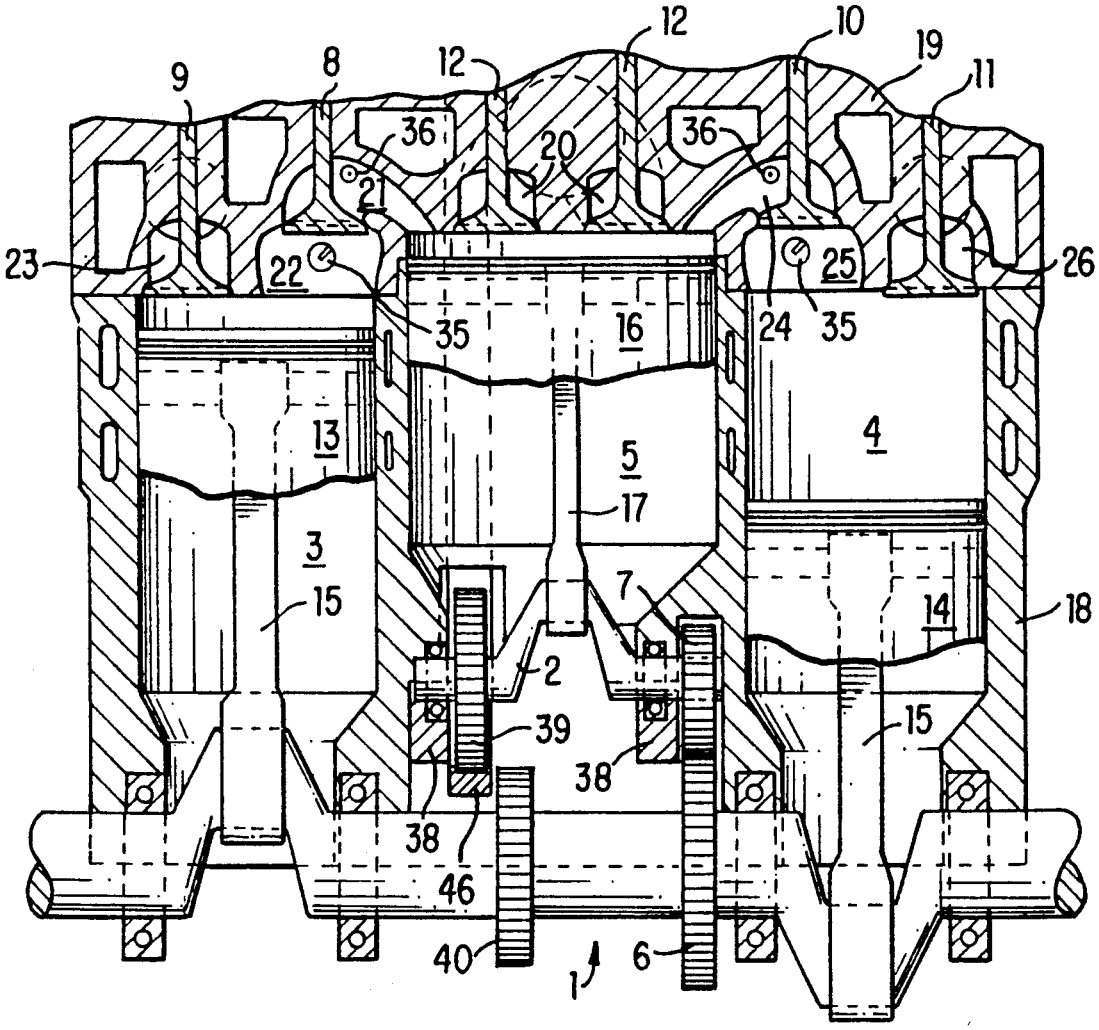
FIG. 2 is a cross sectional view taken along line A—A of FIG. 1 but around the piston crankshaft mechanism and with the lower crankcase removed.
Figure 3:
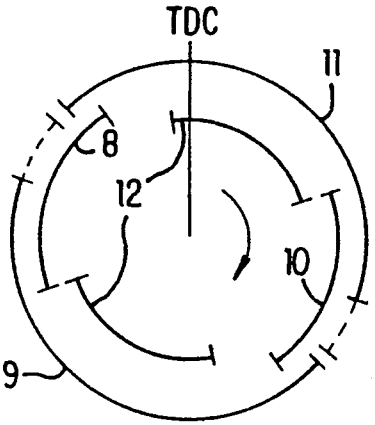
FIG. 3 is a valve timing diagram of the preferred design in power cylinder crank angle degrees with the lines indicating valve open times and with the TDC position shown thereon being the TDC position of the first power piston.

Referring now to FIGS. 1-3, the preferred design or mode for carrying out the invention, is a naturally aspirated inline version which has the pumping cylinder 5 at all load and speed operating conditions, performing a part of the work to raise the pressure of the combustible mixture within the power cylinders, to that which is used for combustion, and is located in the middle of the first and second power cylinders, respectively 3 and 4. The pumping crankshaft 2 is accessed and held in place by pumping crankshaft caps 38 which bolt into the engine block 18 whilst the power crankshaft 1 is accessed and held in place by the lower crankcase which is removed in the FIG. 2. The phasing of the pumping piston 16 relative to the power pistons 13 and 14 has the pumping piston leading the piston of the power cylinder which the intake charge of that particular pumping cylinder cycle will be transferred into, to TDC, by forty power CA degrees.

The preferred design has all intake, transfer, and exhaust valves being poppet type valves. The first and second combustion chambers respectively 22 and 25, remain in constant communication with their respective power cylinder and each has a spark plug 35 mounted thereinto and which causes ignition of the combustible mixture therein. Petrol fuel injection means 36 are mounted into each transfer port and inject a predetermined quantity of fuel thereinto as the said intake charge is being transferred into the power cylinder thereof. A first transfer valve 8 times communication between the first transfer port 21 and the first power cylinder 3 whilst a second transfer valve 10 times communication between the second transfer port 24 and the second power cylinder 4. Two intake valves 12 time communication between the intake port 20 and the pumping cylinder 5. A first exhaust valve 9 times communication between the first power cylinder 3 and the first exhaust port 23 whilst a second exhaust valve 11 times communication between the second power cylinder 4 and the second exhaust port 26. The said exhaust ports lead to an exhaust manifold and eventually to an exhaust pipe whilst the said intake port leads to an intake manifold with air metering means therein provided. All of the said valves are actuated by a single overhead camshaft which has a axis parallel to that of the crankshafts and is positioned directly above all the said valves so as to directly actuate them. The said camshaft is not shown on FIG. 2 to reduce cluttering thereof and of the major features thereof. The said camshaft is driven by chain means 46 from the camshaft drive sprocket 39 which is fixed to the pumping crankshaft 2. The sprocket on the said camshaft which cooperates with the said chain is a half of the diameter as the said camshaft drive gear, providing for the said camshaft to operate at the same cyclic speed as the power cylinders and as such, single camlobes actuate the transfer and exhaust valves, whilst two camlobes are evenly spaced around the said camshaft where the intake valves are actuated from, so that the intake valves open twice as often as the other valves and which follows the increased cyclic speed of the pumping cylinder. Variable exhaust valve closing event is obtained by a turning block type of variable valve timing mechanism which is not shown for reasons of undue complexity and which allows for the said valves to close between fifty and seventy power CA degrees before TDC and depending on engine load and speed. This said variable closing is shown on FIG. 3 by the dashed line thereon. The engine oil pump supplies the oil to the engine and is driven from the oil pump drive gear 40 which is fixed to the power crankshaft 1 between the power cylinders.

The method of operation including the valve timings of the preferred design is now described. The intake valves 12 open when the pumping piston moves through to sixty pumping CA degrees after TDC. This allows the compressed intake gas of the previous cycle to expand substantially to atmospheric before the said valves 12 are opened. With the intake valves 12 opened and the pumping piston moving towards its 'bottom dead centre' (which from hereinafter is referred to as 'BDC') position, the intake air is induced into the pumping cylinder 5. As the said piston 16 moves through forty said CA degrees after BDC the intake valves 12 are closed and the induction of the intake air ceases. At the same time the intake valves 12 close, one of the transfer valves 21 or 24 begins to open, initiating the transfer phase to the respective power cylinder of which the said open transfer valve opens into. The said transfer valve then remains open until the pumping piston 16 moves through to ten said CA degrees after TDC which is shown in FIG. 3 and being thirty five power CA degrees before the piston of the said respective power cylinder reaches TDC. The piston of the pumping cylinder then continues towards BDC, and begins a new cycle thereof as is described above and when the intake valves 12 begin to open again at sixty pumping CA degrees after TDC. The intake air of the next said cycle is transferred to the other power cylinder and the intake air of the following said cycle and which is after the said next cycle is transferred to the said respective power cylinder starting a new cycle thereof.

During the first part of the transfer phase to the said respective power cylinder, the exhaust valve thereof is open, providing for the later part of the exhaust phase thereof to occur which has the scavenging of the remaining exhaust gases from the said respective cylinder by the transferring intake air. The exhaust valve of the said respective power cylinder remains open until the piston thereof moves to between fifty and seventy power CA degrees before TDC. At high load and or high speed, the fuel is injected into the transfer port of the said respective power cylinder during the transfer phase and at low load and or speed, it is mostly injected after the exhaust valve of that power cylinder has closed. With the fuel injected, a spark at the respective spark plug 35 causes combustion to occur about the TDC position. The piston of the said respective power cylinder then moves towards BDC, substantially expanding the gases therein to atmospheric before the exhaust valve begins to open when the said piston is at forty five power CA degrees before BDC. This then initiates the first part of the exhaust phase being blowdown, and then positive scavenging occurs whilst the piston thereof moves towards TDC until the transfer valve of that cylinder opens, beginning another cycle thereof and as is described above. The operation of the other power cylinder is the same as that described above for the said respective power cylinder but as is obvious, it occurs one hundred and eighty power CA degrees before and after it occurs in the said respective cylinder.

Figure 5:
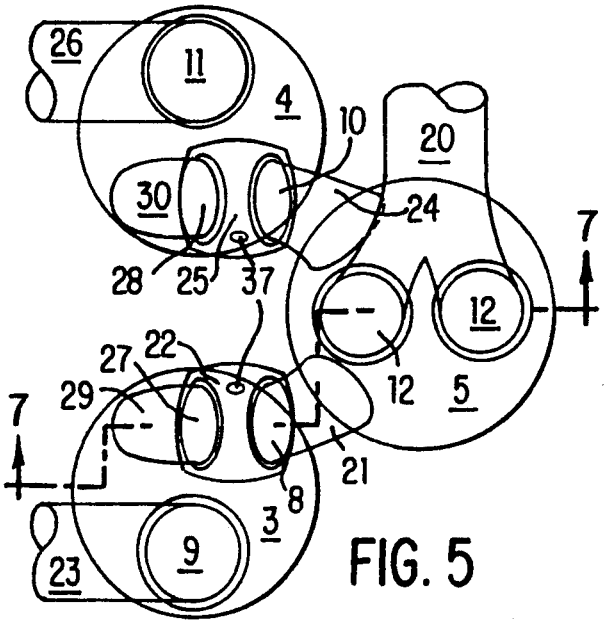
FIG. 5 is a top schematic view of the sectioned unit of FIG. 4 and shows the cylinders, ports, combustion chambers and valve opening locations thereof.
Figure 6:
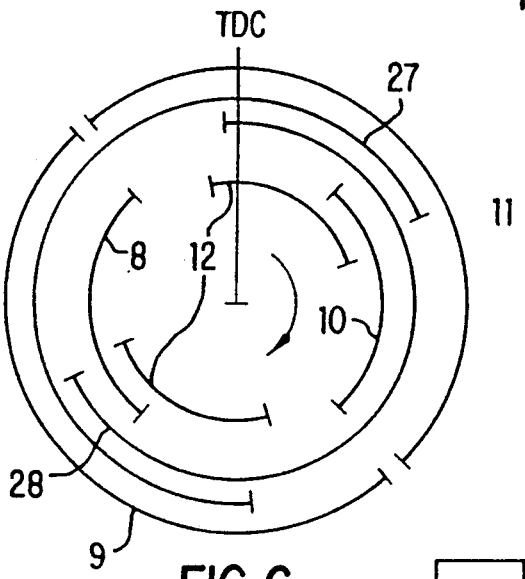
FIG. 6 is a valve timing diagram of the alternative design shown in FIGS. 4 and 5 and uses the same features as described for FIG. 3.
Figure 4:
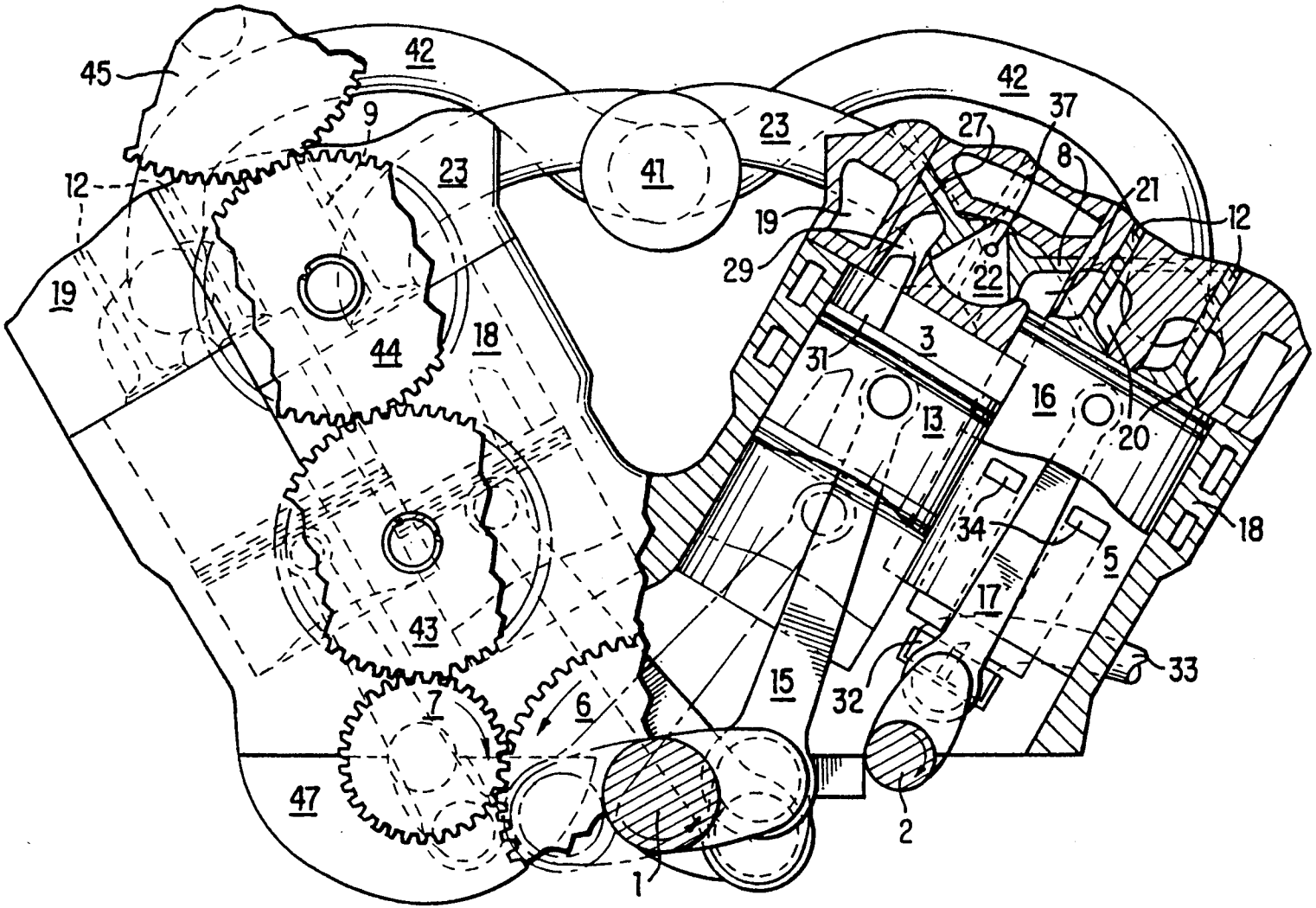
FIG. 4 Shows an alternative design which has two units, being in a V configuration and utilizing turbocharging and crankcase compression of the pumping cylinder. One unit or bank of cylinders is shown as a end view with the other unit shown as a cross sectional view taken along line B—B of FIG. 5 but around the piston crankshaft mechanism thereof and with partial hidden detail shown and the lower power crankcase and lower RH side pumping cylinder crankcase being removed.

Referring now to FIGS. 4–6, the alternative design or mode for carrying out the invention has two units which are set in a V configuration and with each said unit being one bank of cylinders of the said V. The power cylinders of each unit, are positioned close together with the pumping cylinder 5 of each unit being positioned on the outside of the said V but being central to the power cylinders of its said unit. Constant volume combustion chambers which have communication to their respective power cylinders being timed by secondary valves are used in the alternative design with the first said secondary valve being 27 and the second said secondary valve being 28. A turbocharger 41 is positioned in the middle of the said V with the exhaust manifolds 23 of all power cylinders communicating thereto whilst the exhaust, ports 23 and manifolds 23 share the same reference number. The pressurised intake manifold 42 leading from the turbocharger 41 communicates with the intake ports of both pumping cylinders whilst the crankcase intake ports 33 of both pumping cylinders is naturally aspirated. A single power crankshaft 1 causes reciprocation of all power pistons whilst each pumping cylinder 5 has its own pumping crankshaft 2. A single power crankshaft gear 6 which is fixed to the power crankshaft, cooperates with the pumping cylinder drive gears 7, fixed to each of the pumping crankshafts. The phasing of the pumping pistons relative to the power cylinders of a respective unit, has the pumping piston leading the said power pistons to TDC by fifty power CA degrees. The pumping cylinder performs all the mechanical work to raise the pressure of the intake air from the pressure obtained within the pumping cylinder, to the pressure obtained in the combustion chambers due to compression. The phasing of the power pistons of the unsectioned unit relative to the said pistons of the sectioned unit, has the first power piston 3 of the sectioned unit, leading the said first power piston of the unsectioned unit, by ninety power CA degrees. The power crankshaft 1 is accessed and held in place by the lower power crankcase which is removed in the drawings whilst each pumping crankshaft 2 is accessed and held in place by a pumping lower crankcase 47 which is shown on the unsectioned unit of FIG. 4.

The alternative design has all intake, transfer, exhaust and secondary valves being poppet type valves whilst the crankcase intake valves 32 are reed type valves. The first combustion chamber 22 and the first power cylinder 3 has communication therebetween controlled by a first secondary valve 27 whilst the second combustion chamber 25 and the second power cylinder 4 have communication therebetween controlled by a second secondary valve 28. Diesel fuel injection means 37 are mounted into each said combustion chamber whilst ignition therein is caused by the temperature and pressure of the combustible mixture therein. Protrusions 31, on the top of each power piston, extend upwards so that they substantially at least, take up the volumes of each secondary port 29 and 30 which result in an efficiency increase of the engine. The alternative design has each unit having the same intake, transfer, and exhaust valve and port arrangements and functions, as are described for the preferred design although the positioning of some valves and ports is altered. Each said unit has two overhead camshafts which are not shown in the drawings and which are driven by gear means from the pumping cylinder drive gear 7. One of two idler gears 43 cooperates with the said gear 7 whilst the another idler gear 44 cooperates with the idler gear 43 and with the camshaft gear 45 which is the same diameter as the power crankshaft gear 6. The said camshaft gear 45 is fixed to the power camshaft which has single camlobes actuating each transfer, secondary, and exhaust valves whilst another gear which is fixed to the said power camshaft cooperates with a gear which is a half the diameter thereof and which is fixed to the pumping camshaft. The said pumping camshaft has single camlobes actuating the intake valves with the said diameter difference of the relevant gears providing for the increased cyclic velocity of the intake valves.

The method of operation including the valve timings of the alternative mode is now described with reference to a single unit. The intake valves 12 begin to open when the pumping piston moves through to seventy pumping CA degrees after TDC. This allows the compressed intake air from the previous cycle to expand substantially to the pressure of the intake manifold before it opens. With the intake valves 12 opened and the pumping piston moving towards its BDC position, the intake air is induced into the pumping cylinder 5. Whilst the said piston 16 is moving towards BDC, the intake air within the crankcase is compressed. If the engine is operating above or about, fifty percent of its possible load, then the turbocharger 41 is operating efficiently, and as the pumping piston uncovers the crankcase transfer ports 34 at fifty said CA degrees before BDC, then no crankcase transfer occurs as the pressure in the said cylinder resulting from the turbocharger 41 is as high or higher than that of the said crankcase. This then provides for the said crankcase compression to be utilized at the lower loads but not at the higher loads as well as minimizing the maximum pressures attained in the said crankcase which then reduces the sealing requirement thereof and allowing for lighter said reed valve materials with lower opening pressures. As the said piston 16 moves through to fifty said CA degrees after BDC, the crankers transfer ports 34 are closed and when the said piston moves to sixty said CA degrees after BDC, the intake valves 12 are closed and the induction of the intake air through the intake ports ceases whilst if the engine is operating at a low load then on the said pistons up stroke, intake air will be induced into the crankcase through the crankcase intake valves 32. One of the transfer valves opens when the pumping piston is at its BDC position, to initiate the transfer phase to the respective power cylinder which the said transfer valve opens into. The said transfer valve then remains open until the pumping piston has moved to ten said CA degrees after TDC and which is the same as that shown in FIG. 6 and being forty five power CA degrees before the piston of the said respective power cylinder reaches TDC. The piston of the pumping cylinder then continues towards BDC and begins a new cycle thereof when the intake valves begin to open again at seventy pumping CA degrees after TDC whilst the intake air of the next said cycle is transferred to the other power cylinder and so forth as is described hereinbefore.

During the first part of the transfer phase to the respective power cylinder, the secondary valve thereof is open providing for the scavenging of the exhaust gases from the combustion chamber thereof. The said secondary valve closes when the piston of that respective power cylinder has moved to one hundred and fifteen power CA degrees before TDC. During this time the exhaust valve of the said respective power cylinder is open and closes when the piston thereof has moved to forty five power CA degrees before TDC, allowing for nearly all the exhaust gas to be scavenged from the said cylinder except for a small residual portion thereof remaining. This is retained to highly pressurise the remaining gas so that when the secondary valve reopens when the piston thereof is at five power CA degrees before TDC, the pressure in the power cylinder is not significantly lower than that of the combustion chamber thereof which would decrease the thermal efficiency attainable. When the said piston is positioned about forty power CA degrees before TDC, diesel type fuel is injected into the said combustion chamber which results in combustion occurring just after the said relevant transfer valve has closed and so that as the said secondary valve thereof is opened, about fifty percent or more of the combustible mass has been combusted. With combustion completed and the said power piston moving towards BDC, the gas from the combustion chamber flows through the secondary port and open valve thereof to expand substantially to atmosperic before the exhaust valve of the said cylinder is opened when the piston thereof is at forty power CA degrees before BDC. This initiates the exhaust phase of the said cylinder and as the piston thereof moves towards TDC, it positively scavenges the said cylinder until the next transfer phase thereinto begins which starts the next cycle thereof and as is described above. The operation of the other power cylinder has the same said valve and cyclic operation as that described above for the said respective power cylinder but as is obvious, it occurs 180 power CA degrees before and after it occurs in the said respective cylinder.

Figure 7:
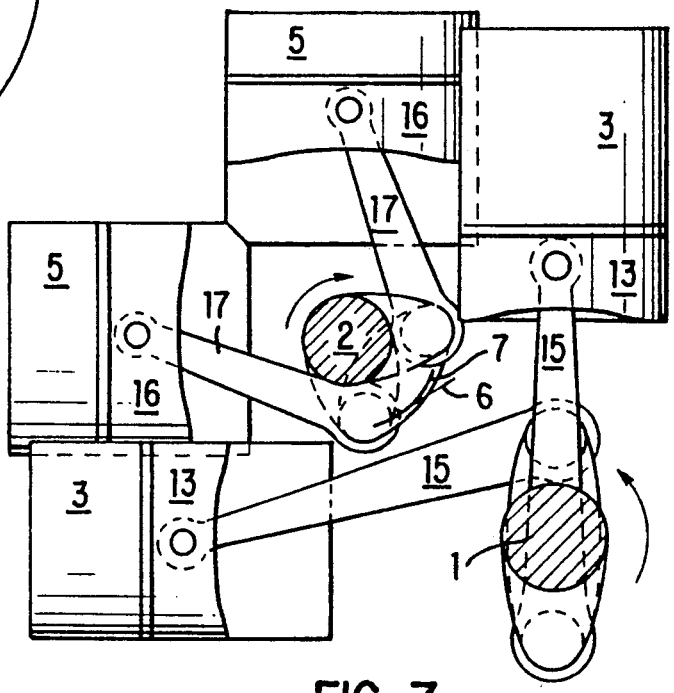
FIG. 7 is a end schematic view of an alternative V configuration and which shows the cylinder and crankshaft locations thereof.

The alternative V configuration of FIG. 7 has two units being in the said configuration with each said unit being one bank of cylinders for the said engine whilst the pumping cylinders 5 thereof are located to the inside of the said V, and of the power cylinders. A single pumping crankshaft 2 causes reciprocation of both said pumping pistons 16 whilst a single power crankshaft 1 causes reciprocation of all said power cylinders.

Obviously, many modifications and variations of the present invention are possible and it is therefore understood that within the scope of the appended claims, the invention may be practised otherwise than as specifically described.

I claim:

1. A two stroke internal combustion engine comprising at least one unit having a pumping cylinder, a pumping piston reciprocally movable in said pumping cylinder, two power cylinders, a respective power piston reciprocally movable in each said power cylinder, each said power cylinder having an associated combustion chamber, the pumping piston reciprocating at a cycle speed twice that of the power pistons and said power pistons being phased about one stroke apart, a cylinder head closing top ends of all said cylinders, said head having two transfer ports therethrough enabling said pumping cylinder to communicate with said power cylinders, transfer valves controlling communication between the pumping cylinder and the power cylinders, at least two exhaust ports through said head allowing exhaust gases to flow from the power cylinders, exhaust poppet valves controlling the flow of the exhaust gases, at least one intake port through the head and communicating with the pumping cylinder, intake valve means associated with the intake port and allowing a major portion of intake charge to be induced into the pumping cylinder when the pumping piston is moving away from its top dead centre position and said pumping piston alternately transferring the charge into the power cylinders through the transfer ports as the pumping piston moves towards its top dead centre position, said pumping piston leads to the top dead centre position the power piston of the cylinder to which the charge is transferred, the transfer valves begin to open when the pumping piston is positioned between 70 degrees after top dead centre and 290 degrees after top dead centre and close when the pumping piston is positioned between 70 degrees before top dead centre and 70 degrees after top dead centre, the exhaust valves opening when the associated said power piston is at about or before its bottom dead centre position.

2. The engine of claim 1 wherein said power pistons are reciprocated by a mainshaft and said mainshaft at least indirectly causes reciprocation of said pumping piston and wherein the pumping cylinder is spaced substantially equal distances from each said power cylinder.

3. The engine of claim 1 wherein said intake valve means begin to open when the pumping piston is positioned between top dead centre and 120 degrees after top dead centre and close when the pumping piston is positioned between 240 degrees before top dead centre and 25 degrees before top dead centre, said exhaust poppet valves begin to open when the power piston is positioned between 80 degrees after top dead centre and 120 degrees after top dead centre and close when the power piston is positioned between 140 degrees before top dead centre and 25 degrees before top dead centre position.

4. The engine of claim 2 wherein the transfer valves close before combustion commences and the combustion chambers are in constant communication with their respective said power cylinders.

5. The engine of claim 2 including a respective secondary valve defining a constant volume said combustion chamber between it and the associated said transfer valve, said secondary valves time communication between the combustion chambers and the power cylinders, the secondary valve of an associated said power piston begins to open when said power piston is at about its top dead centre position and closes when the pumping piston is positioned between 290 degrees before top dead centre and its top dead centre position.

6. The engine of claim 1 wherein the pumping piston leads the power piston to which the intake charge is to be transferred to the top dead centre position by less than 100 power piston degrees before top dead centre.

7. The engine of claim 5 wherein said transfer valves are poppet valves, said pumping piston performs substantially all of the compressive work, said transfer valve and the associated said secondary valve close about when combustion commences and the secondary valve closes about when the associated said transfer valve opens.

8. The engine of claim 4 wherein the transfer valves and the exhaust valves are poppet valves, said valves have a valve head, said heads of the transfer and the exhaust valves being located at least substantially axially above the associated said power cylinder and to one side thereof, said heads of the transfer valves being located higher in the cylinder heads from the heads of the exhaust valves, walls of the combustion chamber from around the transfer valves extending substantially towards the mainshaft so that the walls act to direct the charge from the chamber in a downward direction and said pumping piston performs only part of the compressive work on the charge.

9. The engine of claim 2 wherein the pumping piston is reciprocated by a shaft driven from the mainshaft and the pumping piston shaft has a longitudinal axis located above a longitudinal axis of the mainshaft, said cylinders have longitudinal axes parallel to one another and said axes are in line.

10. The engine of claim 2 wherein the pumping piston is reciprocated by a shaft driven from the mainshaft, said pumping piston shaft including drive means for operating said valves or other engine auxiliary device.

11. The engine of claim 2 wherein that portion of the mainshaft between said power pistons includes means for driving valves or other engine auxiliary device.

12. The engine of claim 1 wherein said pumping cylinder is located within the engine at a higher location than said power cylinder.

13. The engine of claim 1 including two or more said units arranged in a V configuration with all said power pistons being reciprocated by a common said mainshaft and said pumping pistons being reciprocated by a separate shaft.

14. The engine of claim 1 including a crankcase, transfer ports in a lower portion of the pumping cylinder for communicating with the crankcase, said transfer ports in said pumping cylinder being uncovered when said pumping piston is near its bottom dead centre position and crankcase intake valve means timing the communication between a crankcase intake port and said crankcase so that a charge is induced while the pumping piston is moving towards it top dead centre position.

15. The engine of claim 2 wherein the pumping cylinder is positioned between the power cylinders and the distance between said power cylinders is less than the sum of the pumping cylinder bore and two wall thicknesses separating the pumping cylinder and one said power cylinder, the engine further including a turbo charger coupled to an exhaust manifold of each said power cylinder.

16. The engine of claim 15 including a pressurized intake manifold leading from the turbo charger and communicating with the pumping cylinder intake port and wherein said crankcase intake port is naturally aspirated.

17. The engine of claim 2 wherein said intake valve means closes when the pumping piston is positioned between 100 degrees before top dead centre and 70 degrees before top dead centre and said transfer valves open when the pumping piston is positioned between 100 degrees after top dead centre and 290 degrees after top dead centre position.

18. The engine of claim 2 including a variable valve timing mechanism.

19. The engine of claim 1 wherein the exhaust valve remains open until the respective said transfer valve of the power cylinder opens so that a portion of the remaining exhaust gas is scavenged from the power cylinder by the transferred charge.

20. The engine of claim 19 wherein the transfer valve begins to open before the pressure in the pumping cylinder is raised substantially above the pressure in the intake port of the pressure in the power cylinder to which the charge is about to be transferred.

21. The engine of claim 18 in which the exhaust valve closes before the associated transfer valve closes.

22. The engine of claim 1 wherein said intake valves open for a major portion of the time the pumping pistons moves to increase the volume of the pumping cylinder, said respective transfer valve opens for a major portion of the time the pumping piston moves to decrease the volume of the pumping cylinder, said exhaust valves remain open for a major portion of the time required for a stroke of the associated said power piston, substantially all of the air used in combustion is induced into the pumping cylinder and subsequently transferred to the power cylinders.

23. The engine of claim 8 wherein the walls of the combustion chamber which direct the charge downwardly define a major portion of the volume of the combustion chamber.

* * * * *